US006497399B1

(12) United States Patent
Nelson

(10) Patent No.: US 6,497,399 B1
(45) Date of Patent: Dec. 24, 2002

(54) COMPACT PANEL LIFTER

(76) Inventor: Mark S. Nelson, 8714 San Leandro, Dallas, TX (US) 75218

( * ) Notice: Subject to any disclaimer, the term of this patent is extended or adjusted under 35 U.S.C. 154(b) by 0 days.

(21) Appl. No.: 10/156,548

(22) Filed: May 28, 2002

(51) Int. Cl.[7] ..... B66F 3/00
(52) U.S. Cl. ..... 254/131; 254/120; 269/905
(58) Field of Search ..... 254/131, 8 R, 254/120; 269/905

(56) References Cited

U.S. PATENT DOCUMENTS 3,871,054 A * 3/1975 Schaefer ..... 254/131
4,712,771 A * 12/1987 Donnelly et al. ..... 254/131
5,848,668 A * 12/1998 Kafrissen et al. ..... 254/131
6,173,947 B1 * 1/2001 Johnson ..... 269/17
6,302,378 B1 * 10/2001 Koch et al. ..... 254/131
6,322,061 B1 * 11/2001 Maser et al. ..... 269/17

* cited by examiner

*Primary Examiner*—Lee Wilson

(57) ABSTRACT

A simple, compact, hands free device that allows a single operator to vertically lift and hold construction panels to a desired height for securing to a wall surface. Downward foot pressure on one end of a slotted lever arm causes a panel lifting surface on the other end of the lever arm to rise. This lever arm is supported by a base support which also supports a locking arm. Once the desired height is reached, the device locks the panel into position. The operator is then free to move about, adjust, and finally secure the panel. Once the panel is secured, the locking arm is released by simple forward pressure. With the aid of a foot strap, the device can then be transported to the next panel ready for lifting. This device eliminates the use of hands, bending, or stooping during the process of lifting construction panels.

1 Claim, 4 Drawing Sheets

COMPACT PANEL LIFTER

CROSS-REFERENCE TO RELATED APPLICATIONS

Not applicable

STATEMENT REGARDING FEDERALLY SPONSORED RESEARCH OR DEVELOPMENT

This invention was not conceived or produced with the aid of any federally sponsored research or development.

BACKGROUND OF THE INVENTION

1. Field of Invention

This invention relates to a panel lifting device, specifically a simple, inexpensive, hands free device designed to vertically lift and hold construction panels in place for adjusting and securing.

2. Description of Prior Art

Originally devices used for lifting construction panels have included such things as a simple block and pry bar or automobile leaf spring that the installer must stand on. The disadvantage of these devices is that they do not hold a panel in place for securing. Also, the operator must pry and hold with hand or foot at the same time they are adjusting and finally securing the panel. This can cause injury to the operator due to imprecise nature of the devices and imprecision of placement of the panel.

A door transporting and mounting machine in U.S. Pat. No. 4,820,151 to Shern, Mar. 7, 1989 will lift and place a panel against a wall but will not allow for placing the panel laterally flush against an adjacent panel. One disadvantage is that the panel must first be lifted into the device. It also lacks simplicity, low cost of construction and purchase, relative ease of operation, and hands free operation.

A ceiling panel lifting device in U.S. Pat. No. 3,828,942 to Young, Aug. 13, 1974 can be used to lift and hold panels in a vertical position but lacks simplicity, low cost of construction and purchase, relative ease of operation, and hands free operation. Also, the panel itself must initially be hoisted into the device prior to lifting.

Other devices including but not limited to:

(a) U.S. Pat. No. 5,732,527 to Schneider, Mar. 31, 1998

(b) U.S. Pat. No. 4,027,802 to Reynolds, Jun. 7, 1977

(c) U.S. Pat. No. 2,969,220 to Spencer, Jan. 24, 1961 all function only to lift and hold panels against a horizontal ceiling and are not suitable for use in vertically lifting and holding a panel against a vertical wall.

BRIEF SUMMARY OF THE INVENTION

In accordance with the present invention, a compact panel lifter vertically lifts and holds building panels from bottom edge of panel on floor position to bottom edge of panel at a desired height relative to the floor comprising a lever arm, tab, lifting surface, and locking mechanism supported by a self contained support body allowing for hands free foot operated lifting and locking in position of construction panels as well as hands free foot operated lock release of the device with automatic return of the device to the ready position and foot facilitated hands free transfer of the device to subsequent panels.

OBJECTS AND ADVANTAGES

Accordingly, besides the objects and advantages of a compact panel lift device described in my above patent, several objects and advantages of the present invention are:

1. Simple, hands free operation promoting hand safety.
2. Low cost of construction and purchase.
3. Ergonomic transfer of the unit to subsequent panels thus eliminating stooping, bending or squatting with resultant promotion of healthy back hygiene.
4. Locking of the unit into the lifted installation position for adjusting and securing of a panel.
5. No arc of travel when raising a panel thus reducing the risk of the panel falling off a lift structure or the panel pulling away from the wall.

REFERENCE NUMERALS IN DRAWING

Figure 1:
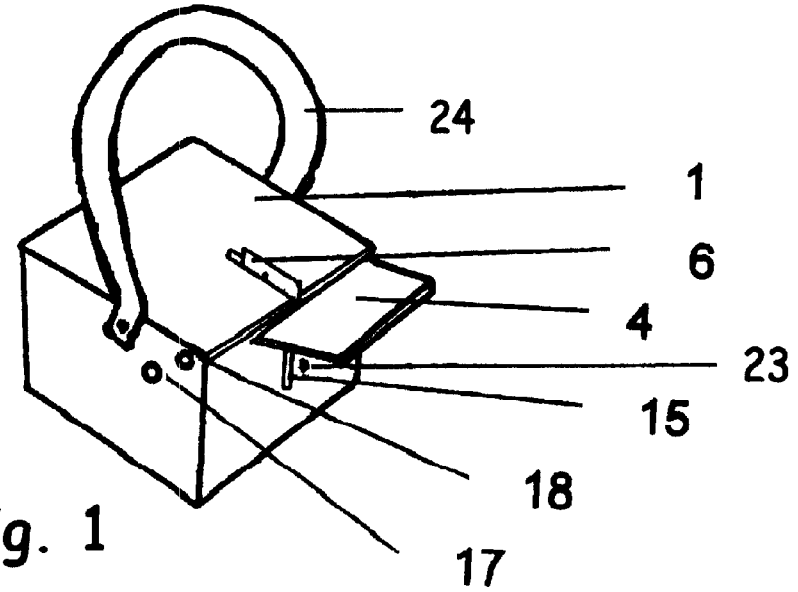
FIG. 1 shows a posterior superior three dimensional view with attached foot strap.

1. Body
2. Lever arm
3. Top cap
4. Pedal
5. Lever arm bolt
6. Locking arm
7. Locking arm bolt
8. Spring
9. Tab
10. Tab bolt
11. Tab washer
12. Tab nut
13. Lifting surface
14. Front slot
15. Rear slot
16. Top slot
17. Lever arm bolt hole
18. Locking arm bolt hole
19. Lever arm/tab attachment hole
20. Tab/Lever arm attachment hole
21. Lever arm bar slot
22. Lever arm serration
23. Spring hole
24. Strap
25. Locking arm bolt hole

DETAILED DESCRIPTION OF THE INVENTION

Figure 2:
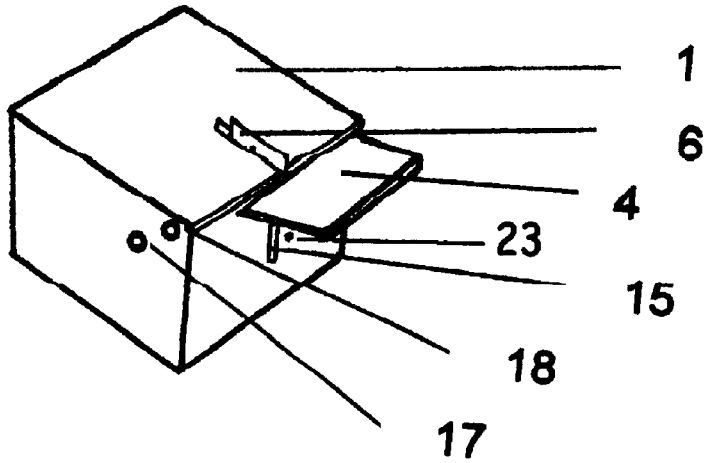
FIG. 2 shows a posterior superior three dimensional view without foot strap.
Figure 3:
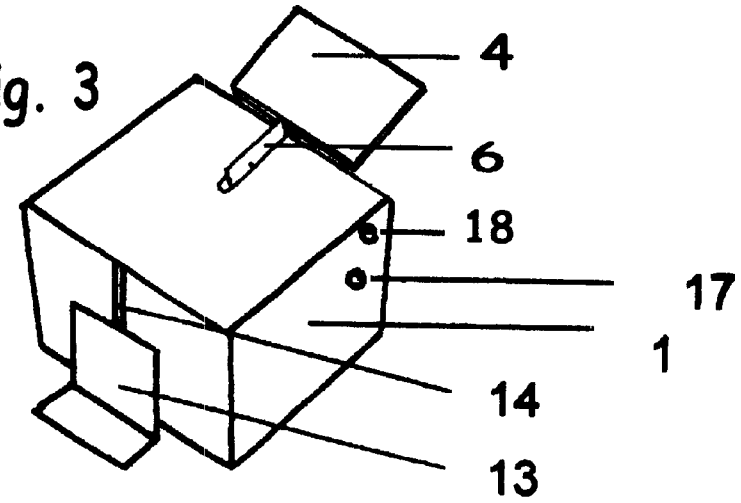
FIG. 3 shows an anterior superior three dimensional view without foot strap.

FIGS. 1 through 3—Preferred Embodiment

A preferred embodiment of the present invention is illustrated in FIGS. 1, 2, and 3.

A body 1 as shown in FIGS. 1, 2, 3, and 4 may be produced from materials such as 11 to 14 gauge 4×4 inch tubular steel (preferred), plastic, or composite. Into the body are cut 2 vertical slots 14 and 15 which serve as travel guides for a lever arm 2, tab 9, and locking arm 6. One slot should be offset to the left or right of the other by the thickness of the lever arm 2. This is to allow for the necessary overlap of the lever arm 2 on the tab 9. The slot width should be just slightly larger than the width of the lever arm 2, tab 9, and locking arm 6 so as to allow for easy unimpeded travel of these parts. A lever arm bolt hole 17 is made in both sides of the body 1 to accept the lever arm bolt 5. The exact position is variable and different positions can be used to obtain different lifting ratios and front to back travel distances of the lever arm 2. A locking arm bolt 18 hole is made in both sides of the body 1 to accept the locking arm bolt 7. This hole is best placed near the posterior superior corner of each side. Depending on which spring mechanism is chosen, a spring hole 23 may be necessary in the front, back or sides to accept one end of a return spring 8.

Figure 4:
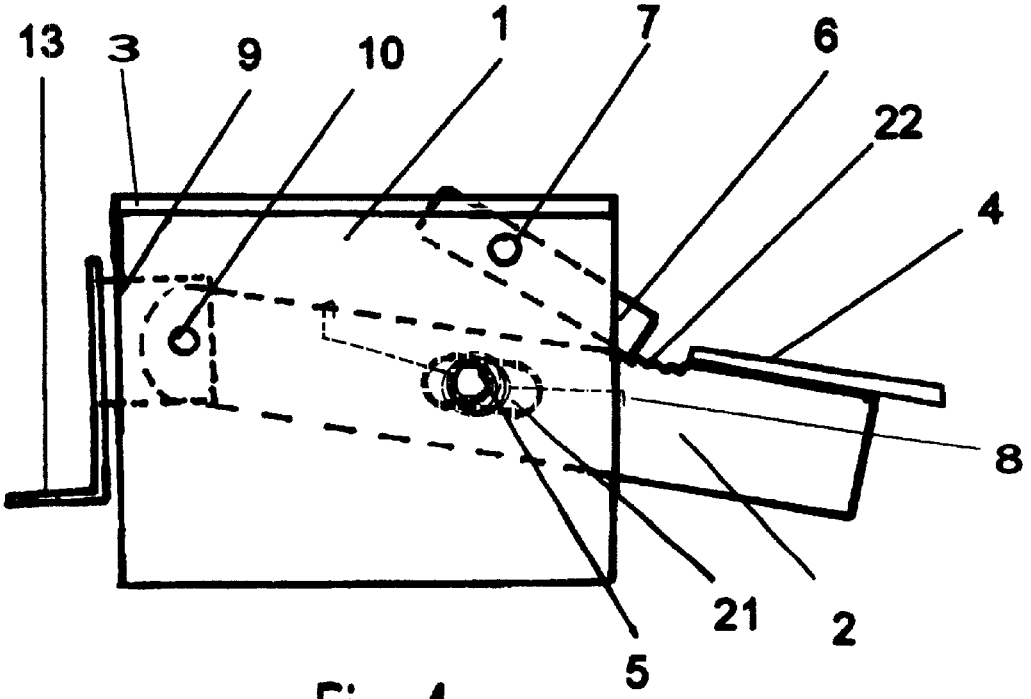
FIG. 4 shows side view.
Figure 5:
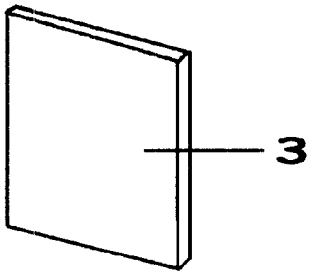
FIG. 5 shows a top cap.

A top cap 3 as shown in FIGS. 4 and 5 may be produced from any material that can be securely attached to the body. Into the top cap is cut a top slot 16. This slot serves as a travel guide for the locking arm 6. The slot must be cut an identical distance from each side of the body as the rear slot 15. The width of the slot should be just slightly larger than the thickness of the locking arm 6 so as to allow for unimpeded travel of the locking arm 6.

Figure 6:
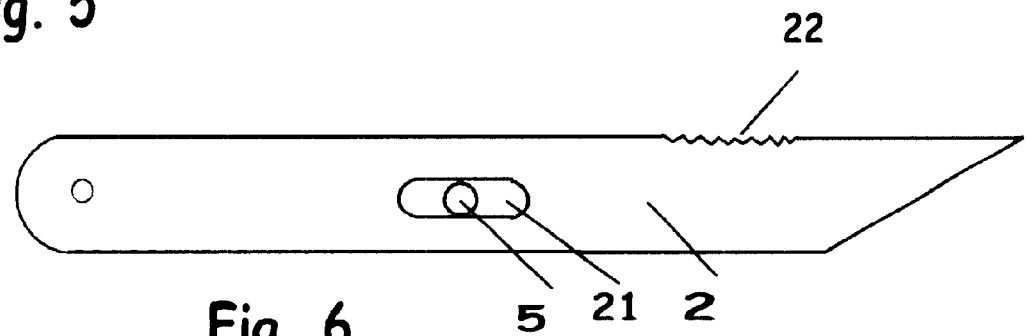
FIG. 6 shows a lever arm.
Figure 7:
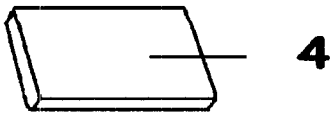
FIG. 7 shows foot pedal.

A lever arm 2 as shown in FIGS. 4 and 6 can be produced from any material with adequate yield strength (stiffness) to prevent bending under the load of the panel lifted. A lever arm bar slot 21 is produced in the lever arm 2 and must be slightly elongated as shown in FIG. 6 to allow for front to rear travel of the lever arm 2 as it rises. The amount of travel depends on the position chosen for the lever arm bolt hole 17. A shallow series of serrations 22 are cut into the posterior superior edge of the lever arm to accept the posterior inferior portion of the locking arm 6. The main consideration is that the point of contact between the locking arm 6 and the serrated portion of the lever arm 22. A material selected for the lever arm 2 must be of sufficient durability to prevent the wearing down of this interface with repeated operation (metal is preferred). The lever arm 2 should be rounded on the front end to allow for equidistant position from the front surface of the body 1 and a tab/lever arm attachment hole 20 during up and down travel. This is what holds the lifting surface 13 flush against the front of the body 1. A lever arm/tab attachment hole 19 is drilled in the front end of the lever arm 2 for attachment to the tab 9. In a preferred embodiment using a formed wire spring, a spring hole 23 is necessary in the rear of the body lateral to the rear slot 15, as is shown in FIG. 1, to accept the rear end of the spring 8.

A pedal 4 as illustrated in FIGS. 1, 2, 3, 4, and 7 produced from any material that can be adequately secured to the rear portion of the lever arm 2.

Figure 8:
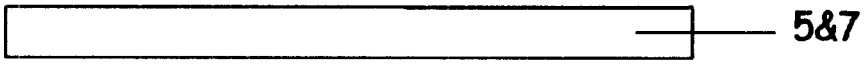
FIG. 8 shows a lever arm bolt or locking arm bolt.

A lever arm bolt 5 as illustrated in FIG. 8 can be produced from any material with adequate yield strength (stiffness). It should be noted that the lever arm is sliding free on the center of the lever arm bolt thus the bolt must be such that it will not bend or break considering the side to side width of the body and the weight of the material lifted.

A locking arm bolt 7 as shown in FIG. 8 may be produced from many materials. As this is a low stress application, yield strength (stiffness) is not a major consideration.

Figure 9:
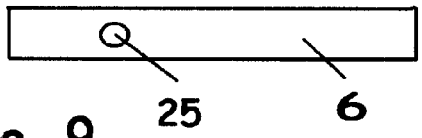
FIG. 9 shows a locking arm.

A locking arm 6 as illustrated in FIG. 9 may be produced from many materials. The main consideration is that the point of contact between the locking arm 6 and the serrated portion of the lever arm 22. Materials selected must be of sufficient durability to prevent the wearing down of this interface with repeated operation (metal is preferred).

Figure 10:
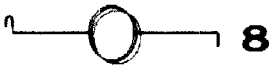
FIG. 10 shows a spring.

A spring 8 as shown in FIG. 10 is needed to exert downward pressure on the front of the lever arm 2 and thus return the lifting surface 13 to the ground position. There are several possible spring configurations. A formed wire spring (preferred) may be anchored to the posterior wall of the body 1, looped around the lever arm bolt 5 and then rest on the anterior superior edge of the lever arm 2. Alternatively coiled springs may be attached from the front or sides of the body 1 to the anterior part of lever arm 2. Any spring arrangement must produce sufficient tension to overcome the inherent friction of the mechanism as a whole.

Figure 11:
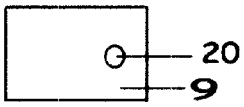
FIG. 11 shows a separate tab.
Figure 12:
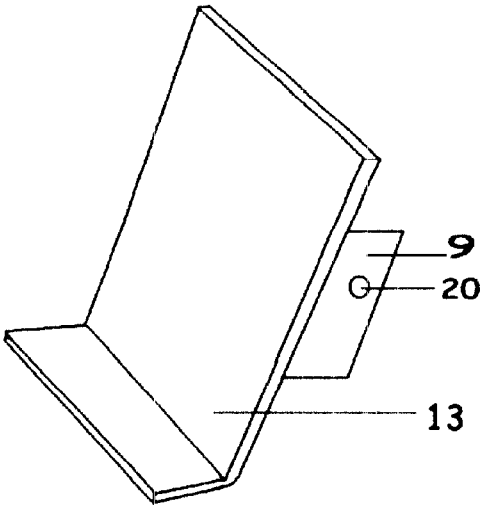
FIG. 12 shows a lifting surface/tab assembly.
Figure 13:
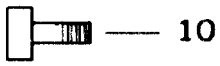
FIG. 13 shows a tab bolt.
Figure 14:
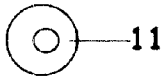
FIG. 14 shows a tab washer
Figure 15:
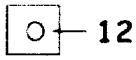
FIG. 15 shows a tab nut.

A tab 9 as shown in FIGS. 11 and 12 may be produced from any material with sufficient strength to support the weight of the material lifted. A tab/lever arm attachment hole 20 should be drilled in the tab 9 to allow attachment to the lever arm 2.

A lifting surface 13 as illustrated in FIGS. 3, 4, and 12 may be produced from any material with sufficient strength to support the weight of the material lifted. There must be a mechanism (such as welding) to attach it securely to the tab 9. A complete lifting surface/tab assembly is shown in FIG. 12.

ADVANTAGES (a) The device allows a panel to be locked snug against a ceiling. The installer is then free to walk about, adjust the panel and secure it without having to continue to stand on a pry bar or leaf spring.

(b) The device is very simple to operate. The operator just steps on the pedal to raise the panel then steps on the anterior portion of the lock arm to release and return the unit to the ready position.

(c) The normal arc encountered in lever arm machines is overcome by a slotted hole in the lever arm. This results in a true vertical lift rather than an arcing lift. This causes the construction panel to travel directly up the wall surface with less risk of pulling away from the wall surface or falling off of the lift surface.

(d) A foot strap allows for transfer of the unit between panels without stooping or bending over to pick it up. Reduction of stooping and bending is known to help reduce the possibility of muscular strain and back injury and is considered good back hygiene.

(e) Operation and transport of the unit requires no hands, only a suitable foot and construction boot. This reduces the possibility of injury to the hands during construction panel lifting operations.

OPERATION OF THE INVENTION

Operation begins with placing the device on the floor and sliding it front side forward toward the panel to be lifted. Placement of the lifting surface should be approximately equidistant from either side of the construction panel. In other words it should be centered or balanced. The lifting surface 13 is forced under the bottom edge of the panel by toe pressure applied to the lower back of the body 1.

Downward foot pressure is then applied to the pedal 4. By direct connection between the pedal 4, lever arm 2, tab 9, and the lifting surface 13, the panel rises. During this operation the locking arm 6 tracks along the lever arm serration 22. Once the desired panel height is reached, the foot is released and by gravity, the locking arm 6 locks the lever arm 2 into position.

Once locked in the raised position with the top edge of the panel against the ceiling, the foot may be released from the pedal 4. The panel may then be adjusted and secured to the wall.

When ready to move to the next panel for installation, the operator inserts a foot into the loop and steps on the forward end of the locking arm 6. This action disengages the locking arm 6 from the lever arm serration 22. The spring then forces the front part of the lever arm 2 along with the attached tab 9 and lifting surface 13 in the downward direction thus returning the unit to the ready position. Then in one motion the foot may be raised while inside the strap 24 and the unit may we "walked" to the next panel and kicked into place.

CONCLUSIONS, RAMIFICATIONS, AND SCOPE OF THE INVENTION

Thus the reader will see that this invention creates a simple, economical, compact, safe, and ergonomic lifting device. This unit not only is highly functional, but has the potential for improving back hygiene and reducing hand injuries related to installation of construction panels. There is also inherent safety in the fact that the operator does not have to stand on the unit while at the same time trying to adjust and secure a panel.

While the above description contains many specifications, these should not be construed as limitations on the scope of the invention. But rather as exemplification of one preferred embodiment thereof. Many other variations are possible. For example the height and size of the unit and parts can be increased to allow for greater lifting heights. The length of the lever arm can be varied to allow for greater or lesser lifting capacity. Materials may be changed to allow either greater or lesser durability or weight. Different shapes are possible without compromising functionality. Any color is possible. Numerous means for manufacture of the lifting arm/tab structure are possible comprising but not limited to two piece construction and attachment, single piece stamping and bending, and one piece molding. In addition the bottom portion of the body can be lengthened to decrease the possibility of unit rocking during operation. Accordingly the scope of the invention should be determined not by the embodiment illustrated, but by the appended claims and their legal equivalents.

What is claimed is:

1. A device for vertically lifting and holding in position construction panels from bottom edge of panel on a flat surface to bottom edge of panel at a desired height relative to that surface comprising:

a body structure;

a lever arm which serves to raise the construction panels positioned on a lifting end of the lower arm when downward foot pressure is applied to a pedal attached to a second end of the lever arm;

a lever arm support rod secured to the body and passing through a slot in a mid section of the lever arm which serves as a fixed fulcrum point for the lever arm;

a lifting surface attached to the lifting end of the lever arm by means of a tab and bolt which allows the lifting surface to track upward in a vertical fashion along a surface of the body;

a locking arm pivoting on a locking arm support rod attached to the body above the lever arm support rod which by gravity allows the locking arm to drop into serrations cut into the top of the lever arm thus locking the lever arm into position;

a return spring connected from the base to the lever arm causing downward pressure on the lifting end of the lever arm and returning the device to the ready position when the locking arm is released by forward pressure; and a foot strap secured to the body allowing a user to insert a foot into the opening then raise the foot thus picking up the device, and carrying it to be positioned for the next operation.

* * * * *